United States Patent [19]

Motykiewicz

[11] Patent Number: 5,010,312

[45] Date of Patent: Apr. 23, 1991

[54] SOLENOID ACTUATORS

[75] Inventor: Krystyn Motykiewicz, Southington, Conn.

[73] Assignee: Rostra Engineered Components, Waterbury, Conn.

[21] Appl. No.: 507,025

[22] Filed: Apr. 10, 1990

[51] Int. Cl.[5] ..... H01F 7/08

[52] U.S. Cl. ..... 335/261; 335/264; 335/279

[58] Field of Search ..... 335/251, 255, 261, 279, 335/264

[56] References Cited

U.S. PATENT DOCUMENTS

| | | | |
|---|---|---|---|
| Re. 32,860 | 2/1989 | Clark | 335/261 |
| 2,882,459 | 4/1959 | Berglund | 335/230 |
| 3,312,842 | 4/1967 | Heuchling et al. | 310/17 |
| 3,577,107 | 5/1971 | Ditzingen et al. | 335/248 |
| 3,993,972 | 11/1976 | Barbrook | 335/220 |
| 4,491,816 | 1/1985 | Blum | 335/261 X |
| 4,583,067 | 4/1986 | Hara | 335/261 |
| 4,633,209 | 12/1986 | Belbel et al. | 335/279 X |

FOREIGN PATENT DOCUMENTS

| | | | |
|---|---|---|---|
| 604601 | 10/1934 | Fed. Rep. of Germany | 335/255 |
| 2036453 | 6/1980 | United Kingdom | 335/261 |

*Primary Examiner*—George Harris

*Attorney, Agent, or Firm*—Lloyd M. Forster

[57] ABSTRACT

A solenoid actuator that includes a ferromagnetic armature body mounted for movement through a defined stroke in the direction of its central axis. A stator includes an electrical coil surrounding the axis of the armature, and a ferromagnetic stator body having a first portion axially opposed to the armature body and a second portion radially surrounding and spaced from the armature body. A ferromagnetic ring is positioned on the armature body radially adjacent and opposed to the second portion of the stator body. The opposed surfaces that define the air gap between the armature ring and the stator body are of identical conical construction and overlap each other as viewed in the axial direction.

12 Claims, 1 Drawing Sheet

SOLENOID ACTUATORS

The present invention is directed to electromagnetic solenoid actuators, and more particularly to improvements in solenoid actuators for obtaining enhanced force/stroke operating characteristics.

BACKGROUND AND OBJECTS OF THE INVENTION

Solenoid actuators of the subject character generally include a ferromagnetic armature mounted for motion through a defined stroke, and a stator positioned adjacent to the armature with a coil for energizing the stator and drawing the armature toward the stator. The armature is coupled to a load, such as a valve element or other control device. The characteristic of force generated by the stator on the armature (and by the armature on the load) versus stroke displacement of the armature varies with a number of design factors or considerations, including geometry of the air gap between the stator and armature. A number of air gap geometries, defined by the opposing surfaces of the armature and stator, have been proposed in the art, including air gaps of at least partially conical construction as in U.S. Pat. Nos. 3,312,842 and 4,583,067.

A general object of the present invention is to provide improvements in construction of solenoid actuators of the subject character that achieve improved efficiency in terms of reduced size and cost for a given output power or stroke requirement. Another and more specific object of the present invention is to provide a solenoid actuator that is characterized by increased output force, as compared with prior art constructions, in the initial portion of the armature stroke, which helps overcome inertia at the load coupled to the armature. Another specific object of the present invention is to provide a solenoid actuator of the described character that is adapted to generate increased force for a given stroke displacement, as compared with prior art devices of a similar character, while operating at or above the point of electromagnetic saturation of the armature and stator structures.

SUMMARY OF THE INVENTION

A solenoid actuator in accordance with a first aspect of the present invention comprises a ferromagnetic armature body mounted for movement through a stroke along a defined axis. (The term "ferromagnetic" in the instant disclosure and claims is employed in its broad or generic sense as encompassing both ferrous and non-ferrous materials of high magnetic permeability.) A stator includes an electrical coil surrounding the axis of the armature, and a ferromagnetic stator body having a first portion axially opposed to the armature body and a second portion radially surrounding and spaced from the armature body. A ferromagnetic flange or ring-like structure is positioned on the armature body radially adjacent and opposed to the second portion of the stator body. The opposed surfaces that define the air gap between the armature ring and the stator body are of identical tapering, preferably conical constructions that are symmetrical with respect to the central axis of the armature and overlap each other as viewed in the axial direction. This conical air gap construction results in greater electromagnetic force being applied to the armature in the initial portion of the armature stroke, and indeed throughout the entire armature stroke, than in prior art constructions in which this portion of the air gap is of radial geometry.

In one embodiment of the invention, the ring is of integral one-piece construction with the remainder of the armature body, and the axial dimension between the ring and the second portion of the stator body when the actuator is fully open is substantially equal to the axial dimension of the air gap between the armature body and the first portion of the stator body. In a second embodiment of the invention, the ring is slidably mounted on the armature body and is urged by a spring in the direction of the armature stroke. The axial dimension of the air gap between the ring and the stator body is less than the axial dimension between the armature and stator bodies, so that the air gap closes between the ring and the stator body while the air gap between the armature and stator bodies is open during the latter portion of the armature stroke. This second embodiment of the invention applies greater force to the armature and load during the entire stroke displacement, both because of the conical geometry of the ring/stator air gap and because the axial dimension of this air gap is reduced. Such an arrangement thus reduces the initial air gap, and increases the initial force on the armature and load, without reducing or changing the total usable stroke of the armature.

Thus, a second important aspect of the present invention contemplates a solenoid actuator in which the armature has separate first and second ferrogmagnetic body portions or sections. The first portion is mounted for movement with respect to an adjacent stator in a defined stroke, and the second portion is moveably mounted on the first portion. The second portion is resiliently urged against the first portion in the stroke direction to a position, when the actuator is fully open, such that the air gap between the second portion and the opposing stator in the stroke direction is less than the air gap between the first portion of the armature and the opposing section of the stator. In this way, as previously noted, not only is greater output force obtained during the initial portion of the armature stroke, but this desirable result is achieved without reducing or changing the total usable armature stroke.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENTS

Figure 1:
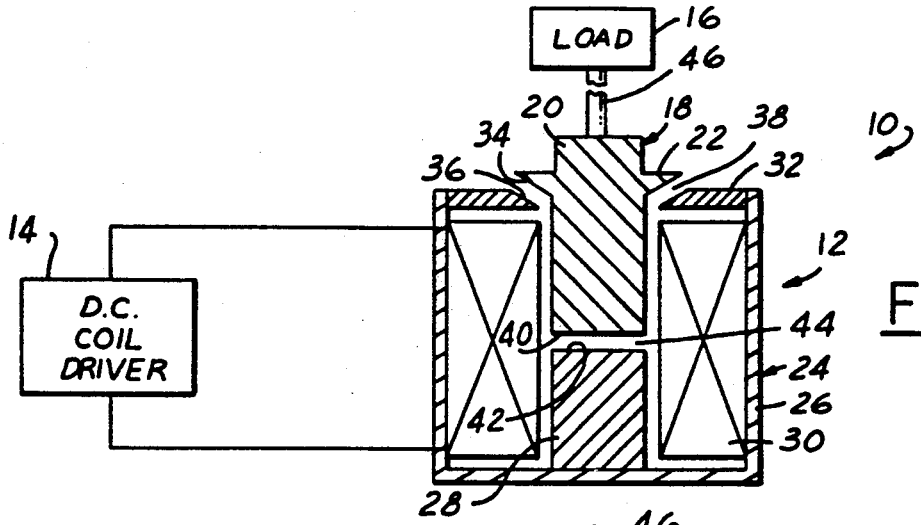
FIG. 1 is a schematic diagram of a solenoid actuator system in accordance with one presently preferred embodiment of the invention.

FIG. 1 illustrates a solenoid actuator system 10 in accordance with the present invention as comprising a solenoid actuator 12 coupled to a d.c. coil driver circuit 14 and to a load 16. Actuator 12 includes an armature 18 composed of a body 20 of cylindrical, square, triangular or other suitable cross section, and a flange ring 22 formed integrally with cylindrical body 20 of suitable ferromagnetic material. A stator 24 includes a U-shaped or C-shaped cup 26 with a central plug 28 carried by its base axially opposed to and aligned with body 20 of stator 18. An electrical coil 30 surrounds plug 28 and armature body 20 within cup 26, and is connected to d.c. coil driver 14. A centrally apertured disk 32 is press fitted or otherwise secured within the open edge of cup 26 over coil 30, with armature 18 extending therethrough to a position opposed to plug 28, and with ring 22 disposed externally of disk 32. Cup 26, plug 28 and disk 32 are of suitable ferromagnetic construction.

Ring 22 and the central opening of disk 32 have opposed conical surfaces 34,36 that are symmetrical with each other and coaxial with the central axis of armature 18. Surfaces 34,36 thus define a conical air gap 38 between armature ring 22 and stator disk 32. (Surfaces 34,36 may be segmented if necessary for other reasons or purposes.) Likewise, armature body 20 and stator plug 28 have opposed axially oriented surfaces 40,42 that define an axial air gap 44 between these portions of the stator and armature bodies. Armature 18 is coupled by a suitable link or shaft 46 to load 16, which in this case includes suitable means (not shown) for biasing armature 18 to the open position with respect to stator 24 illustrated in FIG. 1, and for overcoming magnetic stiction to reopen the armature/stator air gaps upon removal of current from the stator coil. In the embodiment of FIG. 1 the axial dimension of air gap 38 is equal to the axial dimension of air gap 44 when the actuator is in the fully open position as illustrated in the drawing. Armature 18 and stator 24 are circumferentially symmetrical about the central axis of actuator 12.

Upon application of direct current by driver 14 to coil 30, magnetic flux generated in the stator and armature bodies applies an electromagnetic force on armature 18 to move downwardly (in the orientation of FIG. 1) into the stator body and thereby close the air gaps. Upon removal of such current, armature 18 is returned by load 16 (or other suitable means) to the normally open position illustrated in FIG. 1, as previously noted.

Figure 2:
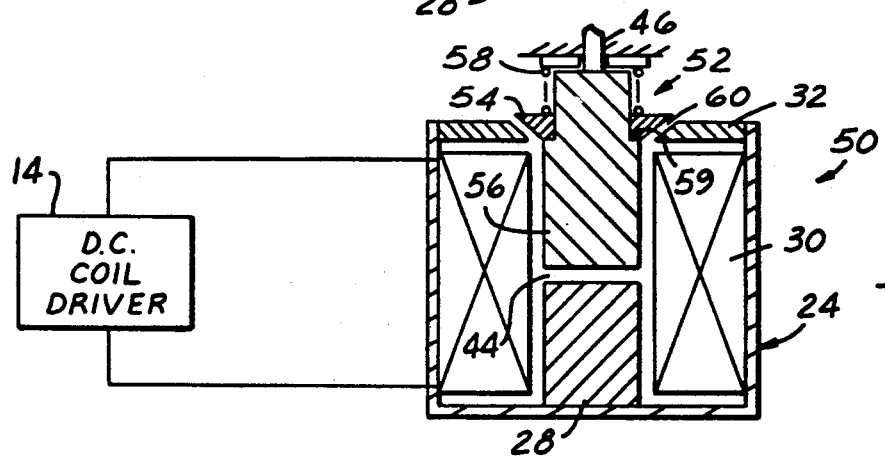
FIG. 2 is a schematic diagram of an actuator system in accordance with a second preferred embodiment of the invention.

FIG. 2 illustrates an actuator system 50 that includes a stator 24 identical to that hereinabove described in conjunction with FIG. 1. The armature 52 in the embodiment of FIG. 2 is composed of a ring 54 separate from cylindrical armature body 56 and slidably disposed thereon externally of stator 24. Armature ring 54 is urged by a coil spring 58 in the direction of the armature stroke against an opposing external shoulder 59 on armature body 56. The axial dimension of the air gap 60 in the embodiment of FIG. 2 is less than that of air gap 44 between armature body 56 and stator plug 28. Thus, upon application of current to stator coil 30 armature 52 is drawn into the stator as previously described. Since the axial dimension of air gap 60 is less than that of air gap 40, air gap 60 closes in the mid portion of the stroke while air gap 44 is still partially open. Upon removal of current from coil 30, load 16 overcomes magnetic stiction of the stator and armature assemblies, and returns armature 52 to the fully open position illustrated in FIG. 2.

Figure 3:
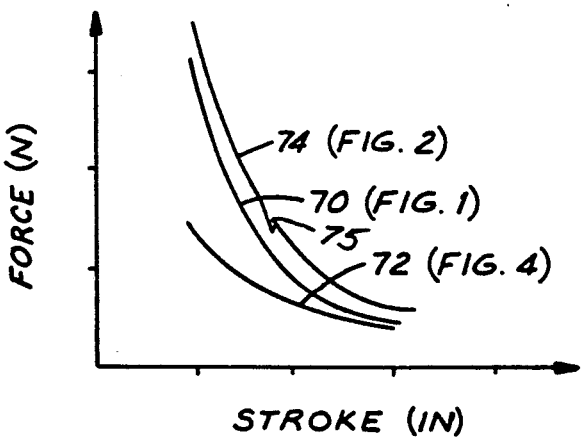
FIG. 3 is a graph that illustrates force versus stroke in the actuators of FIGS. 1 and 2.
Figure 4:
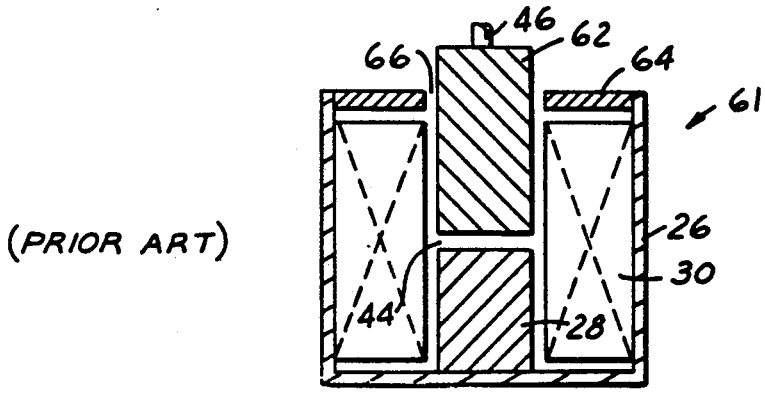
(PRIOR ART) FIG. 4
FIG. 4 is a schematic diagram of a prior art actuator for purposes of comparison in FIG. 3 with the actuators of FIGS. 1 and 2.

FIG. 3 illustrates the enhanced operating characteristics of the embodiments of FIGS. 1 and 2 in accordance with the present invention, in comparison with an actuator 61 illustrated in FIG. 4 constructed in accordance with prior art principles. As shown in FIG. 4, armature 62 of actuator 61 is of cylindrical construction, and the central opening in stator disk 64 is cylindrical. Thus, the air gap 66 between armature 62 and stator disk 64 is of entirely radial dimension, and does not change dimension during motion of the armature into and out of the stator. Radial forces across air gap 66 do not assist motion of armature 62, and the flux energy dissipated in generating these forces is thus wasted. The data graphically illustrated in FIG. 3 was computer-generated by finite element analysis of models per FIGS. 1–2 and 4.

In FIG. 3, the curve 70 depicts the force in newtons generated by actuator 12 (FIG. 1) versus stroke in inches. As seen in FIG. 3, the characteristic 70 of the embodiment of FIG. 1 exhibits a greatly increased force on the armature (and load) during the initial or early portion of the stroke, as compared with the corresponding characteristic 72 for actuator 61 (FIG. 4). Likewise, the curve 74 in FIG. 3 depicts the force versus stroke characteristic of actuator 50 (FIG. 2). It will be noted that the smaller air gap 60 in the embodiment of FIG. 2, as compared with the air gap 38 in the embodiment of FIG. 1, yields an even greater increase in force during the initial portion of the stroke. (The small depression 75 in curve 74 is caused by attractive forces between ring 54 and shoulder 59 after ring 54 bottoms out on stator 24.) Thus, the embodiment of FIG. 2 obtains a reduced initial air gap and increased initial force applied to the armature without changing the total usable stroke of the armature.

The actuators 10,15 in accordance with the invention are also characterized by a reduced actuator response time as compared with actuator 60 of FIG. 4. In one working embodiment of actuator 12, addition of ring 22 and conical air gap 38 (as compared with actuator 61) decreased actuator response time from 7.5 ms to 6.0 ms for the same input current and load. Such a decrease in response time is equivalent to a 50% increase in input power to the coil. Another important advantage of the present invention applies to solenoids that are designed to operate at or above the point of magnetic saturation. That is, in solenoid actuators of this type, the stator and armature constructions are fully saturated with magnetic flux, so that increased input power to the stator coil has no effect on response time and/or armature force. However, provision of conical air gap section 38 or 60 allows generation of additional force without affecting input power.

I claim:

1. A solenoid actuator that comprises: an armature including a ferromagnetic body mounted for movement through a stroke along a defined axis, and a stator including an electrical coil surrounding said axis and a ferromagnetic stator body having a first portion axially opposed to said armature body and a second portion radially surrounding and spaced from said armature body, characterized in that said armature further includes ferromagnetic means moveably mounted on said armature body radially adjacent and opposed to said second portion of said stator body, said means and said second portion of said stator body having opposed axially overlapping tapering surfaces that are symmetrical with respect to said axis.

2. The solenoid actuator set forth in claim 1 wherein said armature body is of cylindrical construction having a central axis coincident with said stroke axis, and wherein said stator body is of circumferentially symmetrical construction surrounding said axis, said tapering surfaces on said means and said second portion of said stator body being of identical opposed conical geometries concentric with said axis.

3. A solenoid actuator that comprises:

a stator including a hollow ferrogmagnetic stator body having an end wall with an opening therein, said opening being defined by a surface of said end wall extending entirely around a central axis of said opening at an acute angle to said axis such that said surface faces axially outwardly of said body at said angle to said axis, said opening having a maximum dimension perpendicular to said axis that is less than that of said end wall, and an electrical coil positioned within said body surrounding said axis, and an armature including a ferromagnetic body mounted within said opening for movement into and out of said stator body along a stroke axis coincident with said axis of said opening, and a flange ring on said armature body positioned externally of said opening, said flange ring having a surface entirely surrounding said axis at said acute angle thereto facing radially outwardly and axially toward said opening-defining surface axially overlapping said opening-defining surface.

4. The solenoid actuator set forth in claim 3 wherein said flange ring is fixedly mounted on said armature body.

5. The solenoid actuator set forth in claim 4 wherein said flange ring is of integral one-piece construction with said armature body.

6. The solenoid actuator set forth in claim 4 wherein said stator body has a first portion within said body spaced from said opening and axially opposed to said armature body, and wherein axial dimension of the air gap between said armature body and said first portion of said stator body when said armature is fully open is equal to axial dimension of the air gap between said means and said second portion of said stator body.

7. The solenoid actuator set forth in claim 3 wherein said flange ring is moveably mounted on said armature body.

8. The solenoid actuator set forth in claim 1 wherein said means comprises a ring slidably externally mounted in said armature body, and wherein said armature further includes means resiliently urging said ring against said armature body toward said second portion of said stator body in a direction to close the air gap therebetween.

9. The solenoid actuator set forth in claim 8 wherein axial dimension of the air gap between said armature body and said first portion of said stator body when said actuator is fully open is greater than axial dimension of the air gap between said ring and said second portion of said stator body.

10. A solenoid actuator that comprises:

an armature having first and second ferromagnetic body portions, said first portion being mounted for movement in a defined stroke direction, and said second portion being mounted on said first portion for movement in said direction with respect to said first portion, a stator including an electrical coil and a ferromagnetic stator body having first and second portions opposed to said first and second portions of said armature respectively, and means resiliently urging said second portion of said armature against said first portion of said armature to a position, when said actuator is fully open, such that the air gap between said second portions in said stroke direction is less than the air gap between said first portions in said stroke direction.

11. The solenoid actuator set forth in claim 10 wherein said armature and said stator are of circumferentially symmetrical construction about a central axis.

12. The solenoid actuator set forth in claim 11 wherein said second portions of said armature and said stator have radially and axially opposed identical conical air gap-defining surfaces concentric with said axis.

* * * * *